US012460853B2

(12) United States Patent
Liu et al.

(10) Patent No.: US 12,460,853 B2
(45) Date of Patent: Nov. 4, 2025

(54) ICE MAKING METHOD FOR REFRIGERATOR AND REFRIGERATOR

(71) Applicants: QINGDAO HAIER REFRIGERATOR CO., LTD., Qingdao (CN); HAIER SMART HOME CO., LTD., Qingdao (CN)

(72) Inventors: Long Liu, Qingdao (CN); Ming Wang, Qingdao (CN); Bintang Zhao, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 78 days.

(21) Appl. No.: 18/684,062

(22) PCT Filed: Apr. 28, 2022

(86) PCT No.: PCT/CN2022/089914

§ 371 (c)(1),
(2) Date: Feb. 15, 2024

(87) PCT Pub. No.: WO2023/029536

PCT Pub. Date: Mar. 9, 2023

(65) Prior Publication Data

US 2025/0060140 A1 Feb. 20, 2025

(30) Foreign Application Priority Data

Aug. 30, 2021 (CN) ..... 202111004773.3

(51) Int. Cl.

| | |
|---|---|
| ***F25C 1/12*** | (2006.01) |
| ***F25C 1/18*** | (2006.01) |
| ***F25D 11/00*** | (2006.01) |

(52) U.S. Cl.
CPC ..... *F25C 1/18* (2013.01); *F25B 2600/23* (2013.01); *F25C 1/12* (2013.01); *F25C 2400/10* (2013.01);
(Continued)

(58) Field of Classification Search
CPC ..... F25C 1/12; F25D 11/00; F25D 2700/122; F25B 2600/23
See application file for complete search history.

(56) References Cited

U.S. PATENT DOCUMENTS 4,872,317 A * 10/1989 Reed ..... F25C 1/04 62/189
5,653,114 A 8/1997 Newman et al.
(Continued)

FOREIGN PATENT DOCUMENTS

CN 102564007 A 7/2012
CN 106949684 A 7/2017
(Continued)

*Primary Examiner* — Lionel Nouketcha
(74) *Attorney, Agent, or Firm* — Muncy, Geissler, Olds & Lowe, P.C.

(57) ABSTRACT

An ice making method for a refrigerator and a refrigerator. The ice making method for a refrigerator comprises: enabling the temperature in an ice making compartment to be higher than or equal to a first preset value; filling an ice making container in the ice making compartment with water; providing cold energy to the ice making compartment according to a first refrigeration capacity, enabling the temperature in the ice making compartment to sequentially drop to reach multiple first preset temperatures, and when the temperature in the ice making compartment drops to reach each first preset temperature, maintaining the temperature in the ice making compartment at the first preset temperature for a corresponding first preset duration, among two adjacent first preset temperatures, the first preset duration corresponding to the lower first preset temperature
(Continued)

being shorter than the first preset duration corresponding to the higher first preset temperature.

10 Claims, 3 Drawing Sheets

(52) U.S. Cl.
CPC ..... *F25D 11/00* (2013.01); *F25D 2700/122* (2013.01)

(56) References Cited

U.S. PATENT DOCUMENTS

| | | | | |
|---|---|---|---|---|
| 8,528,353 | B2 * | 9/2013 | Sung | F25D 29/00 62/229 |
| 2012/0042664 | A1 * | 2/2012 | Lee | F25D 29/00 62/157 |
| 2021/0164727 | A1 * | 6/2021 | Gong | A23B 4/07 |

FOREIGN PATENT DOCUMENTS

| | | | |
|---|---|---|---|
| CN | 110671878 | A | 1/2020 |
| CN | 111156754 | A | 5/2020 |

* cited by examiner

ICE MAKING METHOD FOR REFRIGERATOR AND REFRIGERATOR

TECHNICAL FIELD

The present invention relates to the field of refrigeration and ice-making technology, and in particular, to an ice making method for a refrigerator and a refrigerator.

BACKGROUND

With the continuous development of society and the improvement of living standards, smart technologies are increasingly emerging in the home appliance industry. The intelligence of refrigerators is a major direction in the development of refrigerators and a focus of many companies' research. The demand for refrigerators is no longer just for refrigerating or freezing food, but more for an enhanced experience. Now more and more refrigerators are equipped with ice-making functions, including compartment and door-based ice making methods, and employ either heating or torque methods for unloading ice. However, regardless of the ice making method, the produced ice is typically white ice. White ice refers to the process of water turning into ice, where the air in the water does not escape, resulting in many air gaps within the ice. Due to the different refractive indices of ice and water, the ice appears white and cloudy. Existing ice-making devices generally involve water being poured into an ice tray in the ice maker and frozen directly by the cold generated by an evaporator. This method of freezing results in ice with many air gaps, poor aesthetics, and a tendency to break easily. In other words, the ice produced by typical ice makers is white ice with low transparency, less aesthetic appeal, and fragility.

SUMMARY

In view of the above problems, an object of the present invention is to provide an ice making method for a refrigerator and a refrigerator, which can reduce the air gaps in the ice.

In particular, the present invention is directed to an ice making method for a refrigerator, comprising:

enabling the temperature in an ice making compartment to be higher than or equal to a first preset value;

filling an ice making container in the ice making compartment with water;

providing cold energy to the ice making compartment according to a first refrigeration capacity, enabling the temperature in the ice making compartment to sequentially drop to reach multiple first preset temperatures, and when the temperature in the ice making compartment drops to reach each first preset temperature, maintaining the temperature in the ice making compartment at the first preset temperature for a corresponding first preset duration, among two adjacent first preset temperatures, the first preset duration corresponding to the lower first preset temperature being shorter than the first preset duration corresponding to the higher first preset temperature.

Further, the ice making method for the refrigerator further comprising:

continuing to lower the temperature inside the ice making compartment to a second preset temperature and maintaining the temperature at the second preset temperature for a second preset duration;

providing cold energy to the ice making compartment according to a second refrigeration capacity, and sequentially lowering the temperature inside the ice making compartment to multiple third preset temperatures, wherein when the temperature inside the ice making compartment decreases to each third preset temperature, the temperature is maintained at that third preset temperature for the corresponding third preset duration, among two adjacent third preset temperatures, the third preset duration corresponding to the lower third preset temperature is shorter than the first preset duration corresponding to the higher third preset temperature, the second refrigeration capacity is greater than the first refrigeration capacity.

Further, the ice making method for the refrigerator further comprising:

continuing to lower the temperature inside the ice making compartment to a fourth preset temperature and maintaining the temperature at the fourth preset temperature for a fourth preset duration.

Further, the temperature of the water entering the ice making container is at or above a second preset value.

Further, the first refrigeration capacity is the refrigeration capacity provided by the refrigerator's refrigeration compartment or evaporator for the refrigeration compartment; the second refrigeration capacity is the refrigeration capacity provided by the refrigerator's freezer compartment or evaporator for the freezer compartment.

Further, the second preset temperature equals a target temperature inside the refrigerator's refrigeration compartment; the fourth preset temperature equals a target temperature inside the refrigerator's freezer compartment.

Further, by communicating the ice making compartment with the external environment, the temperature inside the ice making compartment is raised to or above the first preset value; by heating the water supply pipe to the ice making container, the temperature of the water entering the ice making container is raised to or above the second preset value; the water supply pipe is thermally connected to the refrigerator's condenser, thereby heating the water in the supply pipe; the water supply pipe is coiled around the condenser.

Further, the differences between every two adjacent first preset temperatures are equal; the difference between every two adjacent first preset temperatures is between 0.8° C. and 1.5° C.; the difference between every two adjacent first preset temperatures equals the difference between the lowest first preset temperature and the second preset temperature; the differences between every two adjacent third preset temperatures are equal; the difference between every two adjacent third preset temperatures is between 0.8° C. and 1.5° C.

The present invention is further directed to a refrigerator, comprising an ice making compartment with an ice making container inside, wherein the refrigerator further comprises:

a chamber heating unit, configured to raise the temperature inside the ice making compartment to or above a first preset value before supplying water to the ice making container;

a water heating unit, configured to raise the temperature of the water entering the ice making container to or above a second preset value; and a refrigeration device, configured to provide cold energy to the ice making compartment according to the first refrigeration capacity, sequentially lowering the temperature inside the ice making compartment to multiple first preset temperatures, and when the temperature inside the ice making compartment decreases to each first preset temperature, maintaining the temperature at that first preset temperature for the corresponding first preset duration; among two adjacent first preset temperatures, the first preset duration corresponding to the lower first preset temperature being shorter than that for the higher first preset temperature; and after providing cold energy according to the first refrigeration capacity, providing cold energy according to the second refrigeration capacity, sequentially lowering the temperature inside the ice making compartment to multiple third preset temperatures, and when the temperature inside the ice making compartment decreases to each third preset temperature, maintaining the temperature at that third preset temperature for the corresponding third preset duration; among two adjacent third preset temperatures, the third preset duration corresponding to the lower third preset temperature being shorter than that for the higher third preset temperature; with the second refrigeration capacity being greater than the first refrigeration capacity.

Further, the refrigerator further comprising a water supply pipe, condenser, evaporator for the refrigeration compartment, and evaporator for the freezer compartment, with the water supply pipe used to supply water to the ice making container; and an external environment gate control unit, ice-making freezer compartment gate control unit, ice-making refrigeration compartment gate control unit, the water heating unit;

the chamber heating unit is an environment communication device, configured to controllably communicate the ice making compartment with the external space of the refrigerator before the water supply pipe supplies water;

the water heating unit is the aforementioned condenser, with the condenser thermally connected to the water supply pipe;

the refrigeration device comprising the evaporator for the refrigeration compartment and the evaporator for the freezer compartment, both the evaporators configured to controllably provide cold energy to the ice making compartment, with the refrigeration capacity of the evaporator for the refrigeration compartment being the first refrigeration capacity, and the refrigeration capacity of the evaporator for the freezer compartment being the second refrigeration capacity.

In this method, as much air as possible is expelled from the water. Specifically, the temperature inside the ice making compartment is first raised, then the air is allowed to escape by slowly cooling it, controlled by the activation rates of the first and/or second refrigeration capabilities. This prevents the air from being trapped in the ice, forming gaps. Furthermore, the slower the cooling speed at higher temperatures, and the faster at lower temperatures, allows for gradual changes in water temperature, making it more uniform. This reduces the temperature difference between the surface and interior of the water, and allows air in the water to escape, avoiding rapid freezing that traps air in the ice. This method can make the ice blocks transparent, and even create completely transparent, clear ice.

Additionally, the ice making method for the refrigerator and the refrigerator further employs heating to expel air, thereby improving the efficiency and effect of ice-making.

The above and other objects, advantages and features of the present invention will become more apparent to those skilled in the art from the following detailed description of specific embodiments thereof taken in conjunction with the accompanying drawings.

BRIEF DESCRIPTION OF THE DRAWINGS

Some specific embodiments of the invention will be described in detail hereinafter by way of example and not by way of limitation with reference to the accompanying drawings. The same reference numerals identify the same or similar components or parts in the drawings. Those skilled in the art should appreciate that the drawings are not necessarily drawn to scale. In the drawings.

DETAILED DESCRIPTION

Figure 1:
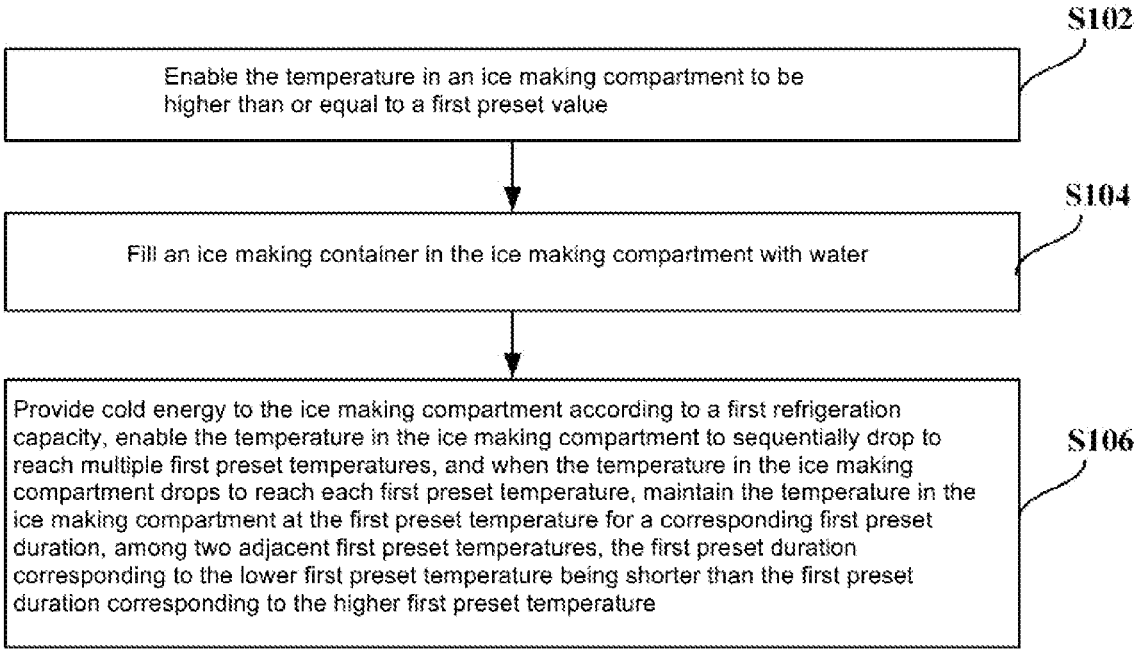
FIG. 1 is a schematic flowchart of an ice making method for a refrigerator according to an embodiment of the present invention.

FIG. 1 illustrates a schematic flowchart of an ice making method for a refrigerator according to an embodiment of the present invention. As shown in FIG. 1, this embodiment provides the ice making method for the refrigerator, comprising:

Step S102: enabling the temperature in an ice making compartment to be higher than or equal to a first preset value, to prevent the temperature inside the ice-making chamber from being too low due to just completing ice-making, which is not conducive to ice-making.

Step S104: filling an ice making container in the ice making compartment with water.

Step S106: providing cold energy to the ice making compartment according to a first refrigeration capacity, enabling the temperature in the ice making compartment to sequentially drop to reach multiple first preset temperatures, and when the temperature in the ice making compartment drops to reach each first preset temperature, maintaining the temperature in the ice making compartment at the first preset temperature for a corresponding first preset duration. Among two adjacent first preset temperatures, the first preset duration corresponding to the lower first preset temperature is shorter than the first preset duration corresponding to the higher first preset temperature.

Figure 2:
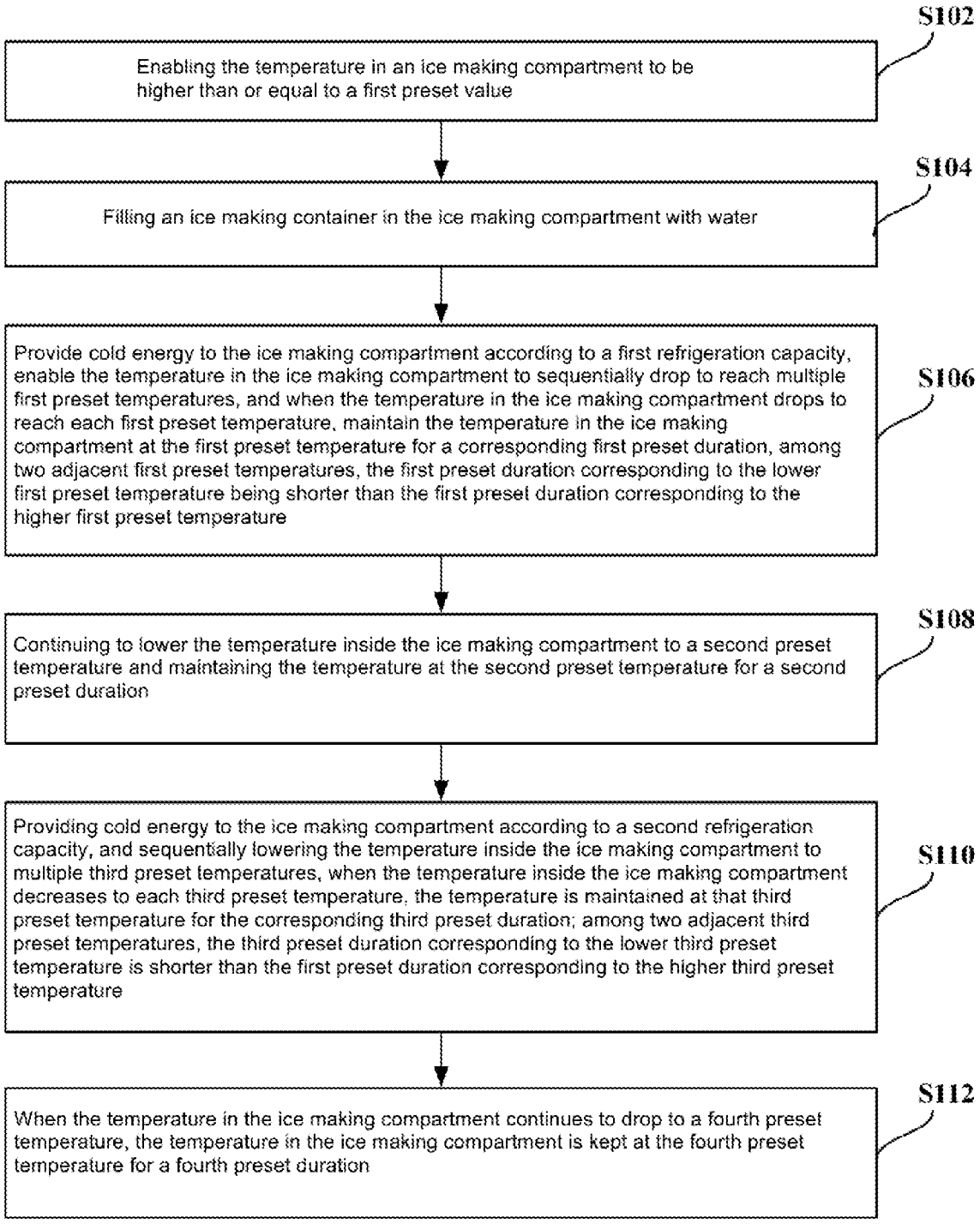
FIG. 2 is another schematic flowchart of the ice making method for the refrigerator according to the embodiment of the present invention.

In further embodiments of this invention, as shown in FIG. 2, the ice making method for the refrigerator further comprises:

Step S108: continuing to lower the temperature inside the ice making compartment to a second preset temperature and maintaining the temperature at the second preset temperature for a second preset duration.

Step S110: providing cold energy to the ice making compartment according to a second refrigeration capacity, and sequentially lowering the temperature inside the ice making compartment to multiple third preset temperatures. When the temperature inside the ice making compartment decreases to each third preset temperature, the temperature is maintained at that third preset temperature for the corresponding third preset duration. Among two adjacent third preset temperatures, the third preset duration corresponding to the lower third preset temperature is shorter than the first preset duration corresponding to the higher third preset temperature. The second refrigeration capacity is greater than the first refrigeration capacity.

By the ice making method for the refrigerator in this embodiment, air in the water can be discharged as much as possible. Specifically, by raising the temperature inside the ice making compartment, and then slowly cooling it by controlling the activation rates of the first and/or second refrigeration capacities, allowing air to escape and not be trapped in the forming ice. The slower the cooling speed at higher temperatures, and the faster the cooling speed at lower temperatures, which can make the water temperature change slowly, so that the temperature of the water tends to be consistent as a whole, reduce the temperature difference between the water surface and the water inside, and can let the air in the water escape, avoid the air caused by rapid freezing is sealed in the ice, and make the ice as transparent as possible, and even create a completely transparent beautiful ice.

In some embodiments of this invention, as shown in FIG. 2, the ice making method for the refrigerator further comprises Step S112: when the temperature in the ice making compartment continues to drop to a fourth preset temperature, the temperature in the ice making compartment is kept at the fourth preset temperature for a fourth preset duration to ensure that the ice is completely made and the ice is completely condensed.

Figure 3:
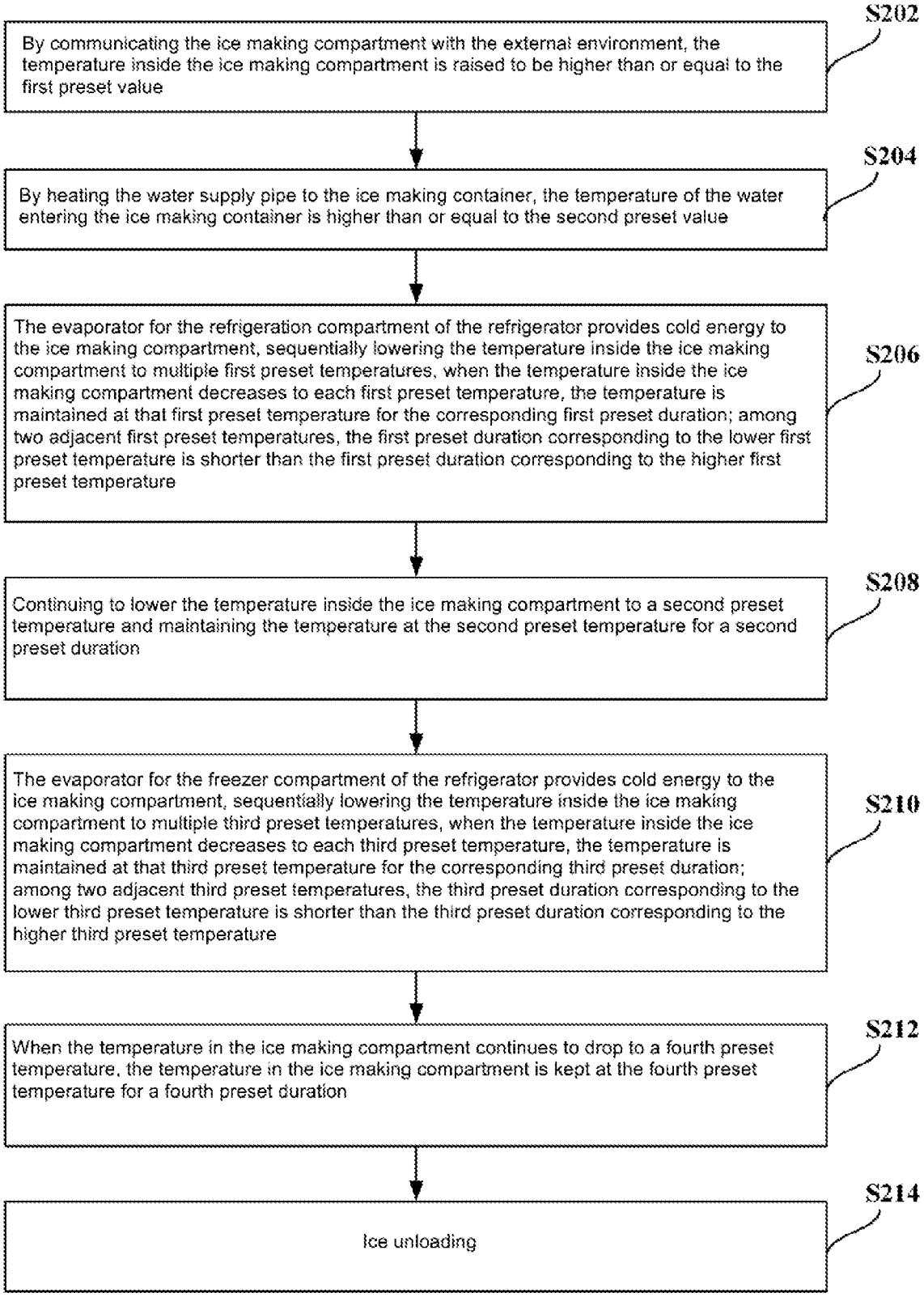
FIG. 3 is a schematic flowchart of an ice making method for a refrigerator according to another embodiment of the present invention.

FIG. 3 is a schematic flowchart of an ice making method for a refrigerator according to another embodiment of the present invention.

In some embodiments, to enhance the efficiency of expelling air, the temperature of the water entering the ice making container is higher than or equal to a second preset value. As shown in Step S204 in FIG. 3, by heating the water supply pipe to the ice making container, the temperature of the water entering the ice making container is higher than or equal to the second preset value. For instance, the water supply pipe is thermally connected to the refrigerator's condenser, thereby heating the water in the supply pipe. The water supply pipe is coiled around the condenser. The ice making method for the refrigerator further employs heating to expel air, thereby improving the efficiency and effect of ice making. That is to say, the water injected into an ice maker from the outside world first flows into the ice maker through the water supply pipe, the water supply pipe is wound with the condenser, and the water will be heated by the condenser during the water flowing, and the air in the water will be discharged, and then the heated water is injected into the ice making container such as ice boxes of the ice maker.

Additionally, as shown in Step S202 in FIG. 3, by communicating the ice making compartment with the external environment, the temperature inside the ice making compartment is raised to be higher than or equal to the first preset value. This is done before filling the ice making container with water, or just after unloading ice, by connecting the ice making compartment to the external environment (room temperature), thereby raising the temperature inside the ice making compartment.

In some embodiments, as shown in FIG. 3, Step S206: The first refrigeration capacity is the refrigeration capacity provided by the refrigerator's refrigeration compartment or evaporator for the refrigeration compartment. Specifically, the evaporator for the refrigeration compartment of the refrigerator provides cold energy to the ice making compartment, sequentially lowering the temperature inside the ice making compartment to multiple first preset temperatures. When the temperature inside the ice making compartment decreases to each first preset temperature, the temperature is maintained at that first preset temperature for the corresponding first preset duration. Among two adjacent first preset temperatures, the first preset duration corresponding to the lower first preset temperature is shorter than the first preset duration corresponding to the higher first preset temperature.

In Step S210, the second refrigeration capacity is the refrigeration capacity provided by the refrigerator's freezer compartment or evaporator for the freezer compartment. Specifically, the evaporator for the freezer compartment of the refrigerator provides cold energy to the ice making compartment, sequentially lowering the temperature inside the ice making compartment to multiple third preset temperatures. When the temperature inside the ice making compartment decreases to each third preset temperature, the temperature is maintained at that third preset temperature for the corresponding third preset duration. Among two adjacent third preset temperatures, the third preset duration corresponding to the lower third preset temperature is shorter than the third preset duration corresponding to the higher third preset temperature.

Steps S208 and S212 are respectively the same as the previously mentioned Steps S108 and S112. The second preset temperature equals a target temperature inside the refrigerator's refrigeration compartment. The fourth preset temperature equals a target temperature inside the refrigerator's freezer compartment.

Further, the differences between every two adjacent first preset temperatures are equal. The difference between every two adjacent first preset temperatures is between 0.8° C. and 1.5° C., preferably 1° C. The difference between every two adjacent first preset temperatures is equal to the difference between the lowest first preset temperature and the second preset temperature. The differences between every two adjacent third preset temperatures are equal. The difference between every two adjacent third preset temperatures is between 0.8° C. and 1.5° C., preferably 1° C.

In this embodiment, the air is allowed to escape, and not be trapped in the forming ice, by specifically controlling the activation rates of the evaporators for the refrigeration and freezer compartments to cool slowly. When water is first introduced, the temperature inside the ice making compartment is consistent with room temperature. At the same time, the temperature difference between the ice making compartment and the refrigeration compartment is significant, thus keeping the activation rate of the refrigeration fan at the lowest. As the temperature drops by 1 degree Celsius, it is maintained at T time. As the temperature difference decreases, the activation rate of the refrigeration fan gradually increases, allowing the water temperature to change slowly and uniformly. This reduces the temperature difference between the surface and interior of the water and allows air in the water to escape, avoiding rapid freezing that traps air in the ice. Similarly, when the evaporator for the freezer compartment begins cooling, the temperature inside the ice making compartment is consistent with that of the refrigeration compartment. Simultaneously, the temperature difference between the ice making compartment and the freezer compartment is significant, the activation rate of the freezer fan is kept at the lowest, as the temperature drops by 1 degree Celsius, it is maintained at T time. As the temperature difference decreases, the activation rate of the freezer fan gradually increases, thereby allowing the water temperature to change slowly and uniformly, thereby reducing the temperature difference between the surface and interior of the water and allowing air in the water to escape, avoiding rapid freezing that traps air in the ice.

In some embodiments of this invention, as shown in FIG. 3, the ice making method for the refrigerator further comprises an ice unloading step S214, in this step, the ice made in the ice making container is detached from the ice making container and transferred to a storage ice container. For example, ice unloading is the movement of ice from the ice making compartment to a storage ice compartment.

This embodiment of the invention further provides a refrigerator, comprising an ice-making device, the ice making compartment, a chamber heating unit, a water heating unit, and a refrigeration device. The ice making compartment is a separate space unit, not directly communicated with other spaces, and made of good insulation materials. The ice-making device has the ice making container defined inside the ice making compartment, which can be an ice tray, ice box, etc. The ice box of the ice-making device is filled with water, and in the cold environment of the ice making compartment, the water is crystallized into ice, and then the ice is flipped into the storage ice container in the ice storage compartment. That is, the storage ice compartment is used to store the ice made from the ice-making device and is communicated with the freezer compartment.

The chamber heating unit is configured to raise the temperature inside the ice making compartment to or above the first preset value before supplying water to the ice making container. The water heating unit is configured to raise the temperature of the water entering the ice making container to or above the second preset value. The refrigeration device is configured to provide cold energy to the ice making compartment according to the first refrigeration capacity, and sequentially lower the temperature inside the ice making compartment to multiple first preset temperatures. When the temperature inside the ice making compartment decreases to each first preset temperature, the temperature is maintained at that first preset temperature for the corresponding first preset duration. Among two adjacent first preset temperatures, the first preset duration corresponding to the lower first preset temperature is shorter than that for the higher first preset temperature. And after providing cold energy according to the first refrigeration capacity, providing cold energy according to the second refrigeration capacity, sequentially lowering the temperature inside the ice making compartment to multiple third preset temperatures. When the temperature inside the ice making compartment decreases to each third preset temperature, the temperature is maintained at that third preset temperature for the corresponding third preset duration. Among two adjacent third preset temperatures, the third preset duration corresponding to the lower third preset temperature is shorter than that for the higher third preset temperature. The second refrigeration capacity is greater than the first refrigeration capacity.

In some embodiments of this invention, the refrigerator further defines a water supply pipe, a condenser, an evaporator for the refrigeration compartment, and an evaporator for the freezer compartment, where the water supply pipe is used to supply water to the ice making container.

The chamber heating unit is an environmental communication device, configured to controllably communicate the ice making compartment with the external space of the refrigerator before the water supply pipe supplies water. The environmental communication device can have an environmental gate, which can connect or disconnect the ice making compartment from the external space of the refrigerator by controlling the opening and closing of the environmental gate. In some alternative embodiments of this invention, a heating device can also be used to heat the ice making compartment.

The water heating unit is the aforementioned condenser, which is thermally connected to the water supply pipe, for example, the water supply pipe being coiled around the condenser. In some alternative embodiments of this invention, an electric heating wire wrapped around the water supply pipe can be used for heating, or the water can be heated in a storage tank.

The refrigeration device includes the aforementioned evaporator for the refrigeration compartment and the evaporator for the freezer compartment. Both evaporators are configured to controllably provide cold energy to the ice making compartment, with the refrigeration capacity of the evaporator for the refrigeration compartment being the first refrigeration capacity, and the refrigeration capacity of the evaporator for the freezer compartment being the second refrigeration capacity. Further, gates and air passages can be used to select whether the evaporator for the refrigeration compartment cools the refrigerator's refrigeration compartment or the aforementioned ice making compartment, and whether the evaporator for the freezer compartment cools the refrigerator's freezer compartment or the aforementioned ice making compartment. In some alternative embodiments of this invention, a dedicated ice-making evaporator can be set up to directly control the ice-making evaporator so that it has different refrigeration capacities at different steps.

So far, it should be appreciated by those skilled in the art that while various exemplary embodiments of the invention have been shown and described in detail herein, many other variations or modifications which are consistent with the principles of this invention may be determined or derived directly from the disclosure of the present invention without departing from the spirit and scope of the invention. Accordingly, the scope of the invention should be understood and interpreted to cover all such other variations or modifications.

What is claimed is:

1. An ice making method for a refrigerator, comprising:

enabling the temperature in an ice making compartment to be higher than or equal to a first preset value;

filling an ice making container in the ice making compartment with water;

providing cold energy to the ice making compartment according to a first refrigeration capacity, enabling the temperature in the ice making compartment to sequentially drop to reach multiple first preset temperatures, and when the temperature in the ice making compartment drops to reach each first preset temperature, maintaining the temperature in the ice making compartment at the first preset temperature for a corresponding first preset duration, among two adjacent first preset temperatures, the first preset duration corresponding to the lower first preset temperature being shorter than the first preset duration corresponding to the higher first preset temperature.

2. The ice making method for the refrigerator according to claim 1, further comprising:

continuing to lower the temperature inside the ice making compartment to a second preset temperature and maintaining the temperature at the second preset temperature for a second preset duration;

providing cold energy to the ice making compartment according to a second refrigeration capacity, and sequentially lowering the temperature inside the ice making compartment to multiple third preset temperatures, wherein when the temperature inside the ice making compartment decreases to each third preset temperature, the temperature is maintained at that third preset temperature for the corresponding third preset duration, among two adjacent third preset temperatures, the third preset duration corresponding to the lower third preset temperature is shorter than the first preset duration corresponding to the higher third preset temperature, the second refrigeration capacity is greater than the first refrigeration capacity.

3. The ice making method for the refrigerator according to claim 2, wherein the first refrigeration capacity is the refrigeration capacity provided by the refrigerator's refrigeration compartment or evaporator for the refrigeration compartment; the second refrigeration capacity is the refrigeration capacity provided by the refrigerator's freezer compartment or evaporator for the freezer compartment.

4. The ice making method for the refrigerator according to claim 2, wherein the differences between every two adjacent first preset temperatures are equal; the difference between every two adjacent first preset temperatures is between 0.8° C. and 1.5° C.; the difference between every two adjacent first preset temperatures equals the difference between the lowest first preset temperature and the second preset temperature; the differences between every two adjacent third preset temperatures are equal; the difference between every two adjacent third preset temperatures is between 0.8° C. and 1.5° C.

5. The ice making method for the refrigerator according to claim 1, further comprising:

continuing to lower the temperature inside the ice making compartment to a fourth preset temperature and maintaining the temperature at the fourth preset temperature for a fourth preset duration.

6. The ice making method for the refrigerator according to claim 5, wherein the second preset temperature equals a target temperature inside the refrigerator's refrigeration compartment; the fourth preset temperature equals a target temperature inside the refrigerator's freezer compartment.

7. The ice making method for the refrigerator according to claim 1, wherein the temperature of the water entering the ice making container is at or above a second preset value.

8. The ice making method for the refrigerator according to claim 7, wherein by communicating the ice making compartment with the external environment, the temperature inside the ice making compartment is raised to or above the first preset value; by heating the water supply pipe to the ice making container, the temperature of the water entering the ice making container is raised to or above the second preset value; the water supply pipe is thermally connected to the refrigerator's condenser, thereby heating the water in the supply pipe; the water supply pipe is coiled around the condenser.

9. A refrigerator, comprising an ice making compartment with an ice making container inside, wherein the refrigerator further comprises:

a chamber heating unit, configured to raise the temperature inside the ice making compartment to or above a first preset value before supplying water to the ice making container;

a water heating unit, configured to raise the temperature of the water entering the ice making container to or above a second preset value; and a refrigeration device, configured to provide cold energy to the ice making compartment according to the first refrigeration capacity, sequentially lowering the temperature inside the ice making compartment to multiple first preset temperatures, and when the temperature inside the ice making compartment decreases to each first preset temperature, maintaining the temperature at that first preset temperature for the corresponding first preset duration; among two adjacent first preset temperatures, the first preset duration corresponding to the lower first preset temperature being shorter than that for the higher first preset temperature; and after providing cold energy according to the first refrigeration capacity, providing cold energy according to the second refrigeration capacity, sequentially lowering the temperature inside the ice making compartment to multiple third preset temperatures, and when the temperature inside the ice making compartment decreases to each third preset temperature, maintaining the temperature at that third preset temperature for the corresponding third preset duration; among two adjacent third preset temperatures, the third preset duration corresponding to the lower third preset temperature being shorter than that for the higher third preset temperature; with the second refrigeration capacity being greater than the first refrigeration capacity.

10. The refrigerator according to claim 9, further comprising a water supply pipe, condenser, evaporator for the refrigeration compartment, and evaporator for the freezer compartment, with the water supply pipe used to supply water to the ice making container; and an external environment gate control unit, ice-making freezer compartment gate control unit, ice-making refrigeration compartment gate control unit, the water heating unit;

the chamber heating unit is an environment communication device, configured to controllably communicate the ice making compartment with the external space of the refrigerator before the water supply pipe supplies water;

the water heating unit is the aforementioned condenser, with the condenser thermally connected to the water supply pipe;

the refrigeration device comprising the evaporator for the refrigeration compartment and the evaporator for the freezer compartment, both the evaporators configured to controllably provide cold energy to the ice making compartment, with the refrigeration capacity of the evaporator for the refrigeration compartment being the first refrigeration capacity, and the refrigeration capacity of the evaporator for the freezer compartment being the second refrigeration capacity.

* * * * *